United States Patent [19]

Bradley et al.

[11] Patent Number: 4,530,730

[45] Date of Patent: Jul. 23, 1985

[54] METHOD OF MAKING ENVELOPE ASSEMBLIES

[75] Inventors: William P. Bradley, Hollidaysburg, Pa.; Michael Herman, Bedford Hills; Robert W. Paltrow, Bedford, both of N.Y.

[73] Assignee: Bedford Engineering Co., Armonk, N.Y.

[21] Appl. No.: 464,648

[22] Filed: Feb. 7, 1983

[51] Int. Cl.[3] ..... B65B 11/48

[52] U.S. Cl. ..... 156/227; 156/250; 156/306.3; 282/25; 493/216; 493/223; 493/228; 493/231

[58] Field of Search ..... 493/216, 227, 223, 224, 493/228, 231; 156/227, 306.3, 250, 267; 283/1 B; 282/25; 53/460, 206

[56] References Cited

U.S. PATENT DOCUMENTS

| | | | |
|---|---|---|---|
| 1,591,231 | 7/1926 | Otis | 282/25 |
| 3,557,519 | 1/1971 | Lyon | 493/216 |
| 4,091,596 | 5/1978 | Jones | 53/460 |
| 4,189,895 | 2/1980 | Volkert et al. | 53/206 |
| 4,411,643 | 10/1983 | Higginson | 493/216 |

*Primary Examiner*—Caleb Weston

*Attorney, Agent, or Firm*—Herman J. Hohauser

[57] ABSTRACT

A method for producing quantities of discrete envelope assemblies including at least one separate enclosure for each assembly, the invention allows formation of the envelope and enclosure from the same sheet of material and allows marking of both envelope and enclosure with indicia which can be unique to each assembly. The method particularly allows continuous, high speed manufacture of assemblies personalized by name and address or the like by printing the indicia on a web of sheet material followed by formation of the web into a plurality of separate envelopes and enclosures with the envelopes and enclosures having like indicia being associated, the method including the use of a fugitive adhesive effected during manufacture, the contour cutting of the web prior to folding and the maintenance of a singular direction of travel of the web and elements cut therefrom throughout manufacture.

13 Claims, 11 Drawing Figures

METHOD OF MAKING ENVELOPE ASSEMBLIES

BACKGROUND OF THE INVENTION

1. Field of the Invention

The invention generally relates to the manufacture of envelopes and enclosures which are personalized, the envelopes and enclosures particularly being separate entities formed from the same web or sheet material and being continuously manufactured at high speed.

2. Description of the Prior Art

High speed web lithographic printing techniques have given rise over the past few decades to exponential increases in the use of direct mail advertising, this practice having been further expanded more recently to include "personalized" letters produced through utilization of computer-controlled printing equipment capable of addressing a letter and even providing personal information previously stored in computer memory. Such prior techniques have expanded the use of direct mail advertising and similar communication by allowing mass mailings to be performed at an extremely low cost relative to previous manual methods. The personalization of mail effectively increases the return to the advertizer or other user. However, the personalization provided to such a letter by this relatively new technology has diminished in impact due to the nature of the envelopes and similar articles onto which the personalized information is printed. Personalized mailings lose a substantial amount of personal value when the person receiving the mailing can easily recognize the mailing as a "form" or "mass" mail advertisement, such poorly-produced mailings being often not opened or read by the recipient even though useful and valuable information is contained in the mailing. The use of "computer print-out" papers wherein an envelope and "letter" are combined together without detachment and often without even removal of edge perforations remaining from printing from a roll further increases the resistance of a recipient to seriously consider such a mailing as personal mail deserving of close attention. Numerous attempts to improve upon the impersonal "personalized" letter have been made in the art such as is evidenced by U.S. Pat. No. 3,557,519 to Lyon, Jr., who describes an integral envelope-letter article intended to provide the effect of a personal letter while retaining the ability to produce such letters in sufficient quantities to be economical within the economic framework of direct mail advertising. As a further example, Jones, in U.S. Pat. No. 4,091,596, provides a method for producing a mailing piece formed of an envelope and an insert. However, the Jones mailing piece is formed of two separate sheets of material blanked from different webs at different locations and mated in an assembly operation, such methodology being logistically difficult and of a speed which is becoming unacceptable in the industry due to cost considerations. Jones particularly provides two changes of direction in the manufacture of the mailing piece so disclosed, a first change of direction occurring on insertion of the separate "letter" portion of the mailing piece into an unglued blank with a second change of direction occurring to facilitate application of adhesive to the envelope blank which is followed by folding and sealing of the mailing piece. Changes of direction in such a processing operation inherently increase the time required for manufacture of a mailing piece. Volkert et al, in U.S. Pat. No. 4,189,895, provide a further example of the manufacture of mass mailing pieces which can be computer-personalized. Volkert et al provide an envelope containing a personalized enclosure which is unattached to the personalized envelope, the envelope and enclosure being formed from the same web of sheet material which has been preprinted. Volkert et al do not provide a mechanism within the mailing piece itself during formation which ensures that the envelope and enclosure are maintained in association with each other during folding and severing operations necessary to cause the envelope and enclosure to become separate entities.

Accordingly, it has become highly desirable to produce personalized mailing pieces consisting of a personalized envelope and a separate personalized enclosure which are separate entities but which are formed from the same preprinted web of sheet material and which particularly gives the effect of an important, personalized letter or other communication such as a telegram or the like. Further, it is particularly necessary in the production of such mailing pieces that the mailing pieces be produced at a high rate of speed in order that economies can be effected without diminution of the personalized quality of the mailing. The present invention addresses these needs by formation of a personalized mailing piece formed of a separate envelope and enclosure and which can be produced in large quantities and at extremely rapid rates of production, thereby allowing the cost of a high personal impact mailing to be produced at a relatively low cost.

SUMMARY OF THE INVENTION

The present invention provides a particular method and a variation of the method for producing mass high speed extremely large quantities of discrete envelope assemblies formed of an envelope and at least one enclosure which constitutes a separate entity from said envelope, the envelope and enclosure being formed from the same web of sheet material. The invention further contemplates the "personalization" of both the envelope and enclosure by preprinting of the web of sheet material, a roll or similar bulk of the preprinted web being first contour cut prior to folding of any portion of the web and prior to scoring at a junction between a portion of the web which will become the envelope and an adjacent portion which will become the enclosure of the mailing assembly. A "fugitive" glue or adhesive which loses "tack" upon drying is then applied behind the scoreline and the enclosure portion of the web is folded back over the envelope portion of the web in order to adhere the two portions together prior to a shearing operation which structurally separates the two portions from each other. The mailing assembly is then further formed by scoring of a seal flap, bottom flap, and side flaps with folding thereof and with application of adhesive to the side flaps and optionally to the seal flap. The envelope is then further formed to enclose the enclosure by folding of the bottom flap portion of the envelope. Additional inserts can be provided in the event the seal flap is not folded over during prior processing. Of particular note is the fact that the web and the envelope and enclosure portions thereof which are severed from the web during manufacture all travel in a singular direction throughout manufacture, thereby allowing exceptionally high speed manufacture of the present mailing assemblies.

Accordingly, it is an object of the present invention to provide a method for producing quantities of discrete envelope assemblies including at least one enclosure which is separate from the envelope, the envelope assemblies being produced at extremely high speeds from a preprinted web of sheet material with the web of sheet material and elements severed from the web traveling in a singular direction throughout manufacture.

It is another object of the invention to provide a method for producing large quantities of mailing pieces formed of separate envelopes and enclosures and wherein the envelope and enclosure is formed from the same sheet of material and which allows the marking of both the envelope and enclosure with indicia which can be unique to each mailing piece.

It is a further object of the invention to provide a unique article of manufacture comprising a mailing piece formed of a discrete envelope and enclosure wherein each envelope and enclosure is personalized with particular preprinted indicia and wherein the personalized envelope and enclosure are associated with each other through use of a fugitive glue or adhesive during manufacture.

Further objects and advantages of the invention will become more readily apparent in light of the following detailed description of the preferred embodiment.

BRIEF DESCRIPTION OF THE DRAWING

The figure is a schematic view of the steps of forming an envelope and enclosure from a continuous paper web with simultaneous incorporation of the enclosure according to the teachings of the present invention.

DESCRIPTION OF THE PREFERRED EMBODIMENTS

Figure 1A:
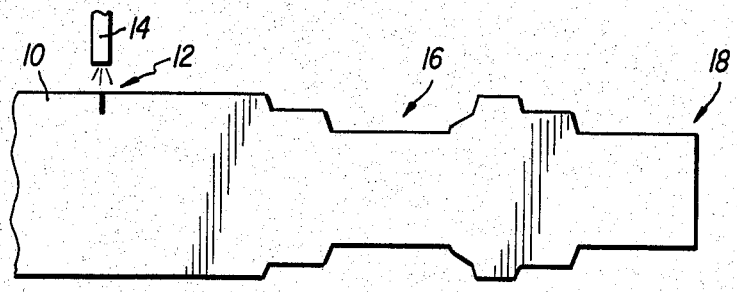
Figure 1B:
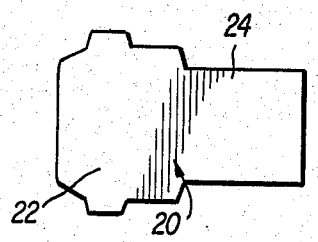
Figure 1C:
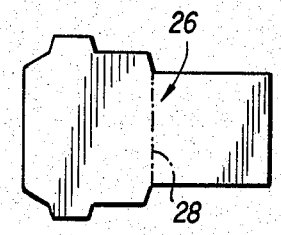
Figure 1D:
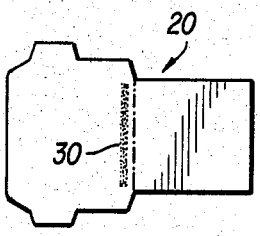
Figure 1E:
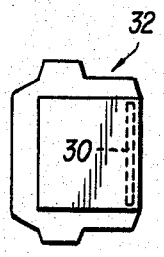
Figure 1F:
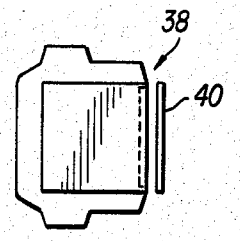
Figure 1G:
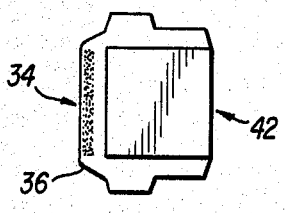
Figure 1H:
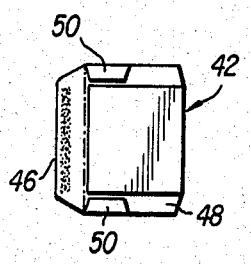
Figure 1I:
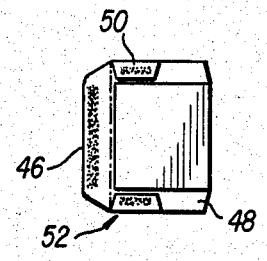
Figure 1J:
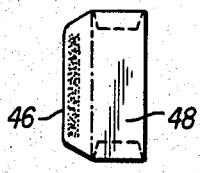
Figure 1K:
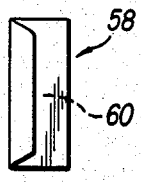

Referring now to the drawing, a preferred method of the invention is schematically illustrated for ease of understanding the basic steps by which the invention allows extremely rapid production of personalized mailing pieces configured in accordance with the structure of the article of the invention. A continuous paper web is seen at 10 to be produced by conventional computer-controlled lithography technology. Such webs as the web 10 are typically four-color lithographed and personalized by means of computer-controlled devices (not shown) such as are well known in the art and as are described at least in part in the issued United States patents mentioned hereinabove and in patents referred to in the above-mentioned United States patents. For simplicity in description of the present invention, these prior art devices and methods will not be described. The web 10 is typically brought to the site of performance of the present methods in a roll-like conformation such that the web is fed from a roll or other storage configuration such as a stack or the like and onto apparatus capable of providing the particular method steps of the invention. A description will also not be provided of the particular apparatus employed since the apparatus can take a variety of forms and can involve modification of conventional apparatus, which modification becomes apparent in view of the teachings herein provided. For these reasons and for simplicity of description, particular apparatus will not be described within the context of the present application for patent.

The web 10 is provided prior to practice of the present methods with personalized information and with any additional printing necessary to convey the intended communication. In particular, the web preferably contains an essentially one thickness of sheet material portions which will eventually be formed into individual envelopes and other portions which will be formed into enclosures to be contained within said envelopes, the "enclosures" and "envelopes" being both formed from the web 10 itself. The portions of the web 10 which are intended to be formed into the envelope portions and the portions of said web 10 which are to be formed into the enclosure or "letter" portions are predetermined by the prior printing of the personalization indicia and by the other indicia forming the communication, design and the like. Accordingly, the web 10 is initially fed into a cutting unit (not shown) and is photo-optically registered within the cutting unit at 12 by means of a conventional optical registering device 14. As the web 10 is fed into the cutting unit, conventional cutting structure (not shown) provide contour cuts, typically on both side edges of the web 10 at 16, essentially identical cuts being periodically made into the web 10. As can be understood from the foregoing, the mention hereinafter of structure used to perform the various operations upon the web and the web portions eventually created are not shown for purposes of simplicity and mention will not hereinafter be made of the fact that such apparatus is not shown.

After contour cutting of the web 10 at 16, the cut web 10 continues to a severing station at 18 where the web 10 is severed perpendicularly to its direction of travel to form discrete assembly blanks 20, the assembly blanks 20 including in an integral piece an envelope portion 22 and an enclosure portion 24. It is to be understood that the envelope portion 22 and the enclosure portion 24 of each assembly blank 20 both include the "personalized" information necessary for the mailing piece, each assembly blank 20 having differing personalized information printed thereon in those situations requiring personalization.

The individual assembly blanks 20 continue to be fed through the apparatus in the same direction in which the web is fed into the processing apparatus, each assembly blank 20 being then subjected to a scoring operation at 26, the scoring operation forming a scoreline 28 on each assembly blank 20 at the juncture of the envelope portion 22 and adjacent enclosure portion 24. The scoreline 28 on each assembly blank 10 then serves to substantially define that portion of the blank 20 which becomes the envelope from that portion of the blank 20 which becomes the enclosure.

Subsequent to the scoring operation at 26, an adhesive material or gum is applied immediately behind the scoreline 28 and on the envelope portion 22 of the blank 20 over an area shown generally at 30. The adhesive is of a type known as a "fugitive" glue which loses tack upon drying but which retains a tacking ability while wet. The portion of the envelope portion 22 over which the fugitive glue is disposed at 30 can take any convenient form such as a substantially rectangular area which need not extend the full length of the scoreline 28 and which also does not need to be disposed contiguously to the scoreline 28 but merely in juxtaposition thereto.

After application of the fugitive glue, the enclosure portion 24 of the blank 20 is folded backwardly over the envelope portion 22 and essentially compressed thereagainst, the folding occurring along the scoreline 28 and causing that area of the enclosure portion 24 adjacent the scoreline 28 to contact the fugitive glue area 30 and to thus tack the enclosure portion 24 to the envelope portion 22. The blank 20 then consists at the location of folding operation 32 of a double thickness of the web material as the blank 20 further travels in a single direction through the manufacturing sequence.

The next processing step involves a shearing at 38 of a substantially rectangular portion 40 from the folded blank 20 to the portion 40 essentially comprising a small quantity of material which includes strips of both the envelope portion 22 and enclosure portion 24 on each side of the scoreline 28. In other words, the shearing operation at 38 essentially removes the material connecting the envelope portion 22 and enclosure portion 24 on each side of the scoreline 28. After the shearing operation, the envelope portion 22 is no longer integral with the enclosure portion 24. However, the envelope portion 22 and the enclosure portion 24 are still maintained in association with each other by means of the fugitive glue area 30. It is to be understood that the enclosure portion 24 is held in a registered position relative to the envelope portion 22 by means of the undried fugitive glue.

In the event the eventual personalized mailing piece is to include inserts additional to the enclosure which is to be formed from the enclosure portion 24, such inserts to be inserted into the envelope which will eventuallv be formed from the envelope portion 22 by conventional inserting methods and apparatus, sealing gum or adhesive is applied at 34 and dried on the appropriate portions of extended seal flap 36. In the event that additional inserts are not to be provided, the seal flap 36 need not be provided with sealing gum at this stage of manufacture.

Associated assembly 42 exiting the shearing and/or sealing gum operation at 38 or 34 respectively continues on in a singular direction to a scoring and folding operation at 44, the operation at 44 particularly scoring the assembly 42 to form a seal flap main body 46, a bottom flap 48 and side flaps 50. The elements 46, 48 and 50 are particularly formed on the envelope portion 22 of the associated assembly 42. However, the operation which differentiates the bottom flap 48 from remaining body portions of the envelope portion 22 also acts to facilitate folding and to actually fold the enclosure portion 24 into substantially two equally sized portions. During the scoring and folding operation at 44, the side flaps 50 are folded inwardly as is seen in the scored and folded associated assembly 42 exiting the scoring and folding operation at 44.

At 52, an adhesive or gum is applied to the exoosed surfaces of the side flaps 50. In the event that the envelope which results from operations on the envelope portion 22 is to be sealed upon delivery and if the sealing gum application at 34 has not been provided, sealing gum is applied to the extended seal flap 36. It is to be understood that the sealing gum application at 34 can be omitted with application to both the side flaps 50 and to the seal flap 46 occurring at 52. However, it is preferred that the adhesive applied to the extended seal flap 36 be dry at the time of insertion of additional inserts (if additional inserts are to be provided). Accordingly, it is necessary to apply the sealing gum to the extended seal flap 36 and dry said sealing gum prior to application of sealing gum to the exposed portions of the side flaps 50 since it is not desired to dry the sealing gum on the side flaps 50 at this point of manufacture. It is again stressed that the sealing gum which is applied to the extended seal flap 36 is dried for the purpose of allowing the insert of additional material such as return address envelopes and the like as desired. In the event that inserts additional to that provided by the enclosure portion 24 are not to be provided, then sealing gum or adhesive can be applied to the extended seal flap 36 at 52 at the same time that adhesive is applied to the exposed portions of the side flaps 50, all adhesive material then applied being allowed to remain wet throughout the remaining manufacturing steps.

At 54, the bottom flap portion 48 along with the lower portion 56 of the enclosure portion 24 are folded back over the body of the envelope portion 22. The enclosure portion 24 is thus disposed inside of the gummed side flaps 50 while the surmounting portions of the bottom flap 48 contact the gummed exposed surfaces of the side flaps 50, thereby adhering the bottom flap 48 to the side flaps 50. The envelope portion 22 is thus formed into an envelope as is seen at 58 and which contains a "letter" 60 formed from the enclosure portion 24 and folded within the envelope 58.

When no additional insertion into the envelope 58 is to take place, the single flap main body 46 is then folded into contact with the bottom flap 48 to seal the envelope 58, the envelope 58 and contained letter 60 then being ready for mailing. In such a situation, the sealing gum or adhesive which is applied at 52 is still intended to be wet to allow ready sealing at this stage of processing. In the event that additional inserts are to be deposited into the envelope 58, then the sealing gum application at 34 and subsequent drying of said sealing gum would have been provided such that the inserts could be made in a conventional manner and the envelope 58 subsequently sealed by means of moistening of the previously applied and dried sealing gum and the folding of the seal flap main body 46 into contact with the bottom flap 48 in a manner substantially identical to that described for sealing of the envelope 58 when no inserts are to be provided.

The present invention thus provides methods for high speed manufacture of discrete envelope assemblies or mailing pieces comprised of personalized envelopes and enclosures which are separate from each other in final assembly but which are formed from the same web of preprinted sheet material. The present methods particularly allow the continuous, high speed manufacture of personalized mailing pieces in large volumes and at relatively low cost. It is to be further stressed that the ability of the present methodology to be practiced at high speeds derives in part from the fact that all processing operations essentially take place in the same direction as the direction of travel of the web 10 as the web 10 is fed into the processing theater, this processing within the same direction allowing high speed operation and reducing stoppages and losses of material. It is further to be understood that the invention can be practiced other than as is explicitly described herein, the scope of the invention being defined by the appended claims.

What is claimed is:

1. A high speed method for producing a plurality of mailing assemblies each such mailing assembly comprised of an envelope and an enclosure consisting of the following steps;

a. providing a plurality of blanks of sheet material with each blank being comprised of an envelope portion having at least two flap sections and an enclosure portion;

b. separating said plurality of blanks one at a time so that formation of each discrete blank into an envelope with an enclosure can be accomplished rapidly one after the other;

c. applying adhesive on each of said blanks having tack when wet and no tack when dry;

d. folding said enclosure portion of a single blank upon said envelope portion of said blank to form a double thickness of sheet material with said enclosure portion covering substantially all of said envelope portion with the exception of three edges of said envelope portion including said two flap sections wherein one thickness represents said envelope portion and the other thickness represents said enclosure portion;

e. separating said enclosure portion from said envelope portion to form two discrete pieces of sheet material and retaining said double thickness of material;

f. applying adhesive material to predetermined areas on said envelope portion;

g. folding said two flap sections of said envelope portion not covered during the step d. folding step; and h. folding said double thickness of sheet material to form an envelope assembly having an enclosure.

2. The method of claim 1 wherein adhesive is applied to said two flap sections before step g. and after step h.

3. The method of claim 1 wherein in step h. said two flap sections are folded on the same side of the remaining section of said envelope portion as said enclosure portion covers.

4. The method of claim 1 wherein the manufacturing steps proceed in the same direction of travel throughout the mailing assembly production operation.

5. The method of claim 4 wherein adhesive is applied to said two flap sections before step g. and after step h.

6. The method of claim 1 further comprising the step of scoring each blank before folding pursuant to step d. to form a scoreline dividing said envelope portion from said enclosure portion.

7. The method of claim 6 wherein the manufacturing steps proceed in the same direction of travel throughout the mailing assembly production operation.

8. The method of claim 6 wherein adhesive is applied to said two flap sections before step g. and after step h.

9. A high speed method for producing a plurality of mailing assemblies each assembly comprised of an envelope and an enclosure consisting of the following steps:

a. providing a plurality of blanks of sheet material each having printing thereon and being comprised of an envelope portion having at least two flap sections and an enclosure portion;

b. scoring each blank to form a scoreline that divides said envelope portion from said enclosure portion;

c. applying adhesive on each of said blanks having tack when wet and no tack when dry;

d. folding said enclosure of a single blank upon said envelope portion of said blank to form a double thickness of sheet material with said enclosure portion substantially covering said envelope portion;

e. separating said enclosure portion from said envelope portion to form two discrete pieces and retaining said double thickness of material;

f. folding said two flap sections of said envelope portion not covered during the step d;

g. applying adhesive to said two folded flap sections; and h. folding said double thickness of sheet material to form an envelope assembly having an enclosure.

10. The method of claim 9 wherein the manufacturing steps proceed in the same direction of travel.

11. The method of claim 9 wherein step h. said two flap sections are folded on the same side of the remaining section of said envelope portion as said enclosure portion cover.

12. The method of claim 9 wherein at least two edges of said envelope portion are sealed upon folding said double thickness of sheet material to form an envelope assembly having an enclosure.

13. The method of claim 12 wherein the manufacturing steps proceed in the same direction of travel.

* * * * *